US005919084A

United States Patent [19]

Powell et al.

[11] Patent Number: 5,919,084

[45] Date of Patent: Jul. 6, 1999

[54] TWO-SIDED ABRASIVE TOOL AND METHOD OF ASSEMBLING SAME

[75] Inventors: David G. Powell, Wellesley Hills; Stanley A. Watson, Franklin, both of Mass.

[73] Assignee: Diamond Machining Technology, Inc., Marlborough, Mass.

[21] Appl. No.: 08/881,943

[22] Filed: Jun. 25, 1997

[51] Int. Cl.[6] ..... B24B 23/00; B24D 15/00

[52] U.S. Cl. ..... 451/344; 451/523; 451/524; 451/557

[58] Field of Search ..... 451/344, 523, 451/524, 533, 538, 539, 557

[56] References Cited

U.S. PATENT DOCUMENTS

| | | |
|---|---|---|
| 2,360,798 | 10/1944 | Seligman et al. . |
| 3,287,862 | 11/1966 | Abernathy . |
| 3,517,464 | 6/1970 | Mattia et al. . |
| 3,785,938 | 1/1974 | Sam . |
| 3,860,400 | 1/1975 | Prowse et al. . |
| 4,047,902 | 9/1977 | Wiand . |
| 4,078,906 | 3/1978 | Green . |
| 4,079,552 | 3/1978 | Fletcher . |
| 4,155,721 | 5/1979 | Fletcher . |
| 4,256,467 | 3/1981 | Gorsuch . |
| 4,381,227 | 4/1983 | Narcus . |
| 4,460,382 | 7/1984 | Ohno . |
| 4,560,853 | 12/1985 | Ziegel . |
| 4,608,128 | 8/1986 | Farmer et al. . |
| 4,826,508 | 5/1989 | Schwartz et al. . |
| 4,874,478 | 10/1989 | Ishak et al. . |
| 4,945,686 | 8/1990 | Wiand . |
| 5,022,895 | 6/1991 | Wiand . |
| 5,049,165 | 9/1991 | Tselesin . |
| 5,131,924 | 7/1992 | Wiand . |
| 5,133,782 | 7/1992 | Wiand . |
| 5,161,335 | 11/1992 | Tank . |
| 5,203,881 | 4/1993 | Wiand . |
| 5,317,839 | 6/1994 | Anderson . |

FOREIGN PATENT DOCUMENTS

| | | |
|---|---|---|
| 0 238 434 A2 | 9/1987 | European Pat. Off. . |
| 1 229 980 | 4/1971 | United Kingdom . |
| WO 93/04818 | 3/1993 | WIPO . |
| WO 96/14963 | 5/1996 | WIPO . |

OTHER PUBLICATIONS

Diamond Machining Technology, Inc., Unique Diamond Sharpening Products For Industry (1996).

Miller, Paul C., "Cutting–tool coatings: Many strengths," Tooling & Production, Sep., 1991, pp. 34–37.

*Primary Examiner*—David A. Scherbel
*Assistant Examiner*—Philip J Hoffmann
*Attorney, Agent, or Firm*—Fish & Richardson P.C.

[57] ABSTRACT

An abrasive tool and method for assembling same includes a first base having a front surface and a back surface and a second base having a front surface and a back surface. A first perforated sheet has a front surface and a back surface, the back surface of the first perforated sheet being bonded to the front surface of the first base. A second perforated sheet has a front surface and a back surface, the back surface of the second perforated sheet being bonded to the front surface of the second base. A first layer of abrasive grains is bonded to the front surface of the first perforated sheet, and a second layer of abrasive grains is bonded to the front surface of the second perforated sheet. The back surface of the first base is bonded to the back surface of the second base. The back surfaces of the bases may be bonded by sonic welding.

31 Claims, 5 Drawing Sheets

TWO-SIDED ABRASIVE TOOL AND METHOD OF ASSEMBLING SAME

BACKGROUND OF THE INVENTION

This invention relates to an abrasive tool, and in particular, a tool with perforations on each of two abrasive sides.

An abrasive tool may be used to sharpen, grind, hone, lap or debur a work piece or substrate of hard material, e.g., a knife. Such an abrasive tool may have a surface coated with abrasive grains such as diamond particles.

An abrasive tool having an abrasive surface with depressions, e.g. an interrupted cut pattern, is known to be effective when applied to various work pieces. Abrasive tools must be rigid and durable for many commercial and industrial applications.

SUMMARY OF THE INVENTION

In general, in one aspect, the invention features an abrasive tool including a first base having a front surface and a back surface and a second base having a front surface and a back surface. A first perforated sheet has a front surface and a back surface, the back surface of the first perforated sheet being bonded to the front surface of the first base. A second perforated sheet has a front surface and a back surface, the back surface of the second perforated sheet being bonded to the front surface of the second base. A first layer of abrasive grains is bonded to the front surface of the first perforated sheet, and a second layer of abrasive grains bonded to the front surface of the second perforated sheet. The back surface of the first base is bonded to the back surface of the second base.

Implementations of the invention may include one or more of the following features. The back surface of the first base may be bonded to the back surface of the second base by sonic welding. The first and second perforated sheets may have perforations arranged to form an interrupted cut pattern.

The first base and the second base may comprise a plastic material. The back surfaces of the first and second bases may be joined by sonic weld joints on the back surfaces of the first and second bases. The front surfaces of the first and second bases may be bonded to the back surfaces of the first and second sheets respectively by injection molding.

The perforations in the perforated sheets may be counterbored. The front surfaces of the first and second bases may be bonded to the back surfaces of the first and second sheets respectively by injection molding. The injection molded bond may anchor the first and second perforated sheets to the first and second bases respectively by the counterbored perforations.

The first and second perforated sheets may have perforations in a portion less than the entirety of the sheets. The tool may be a file.

The first and second layers of abrasive grains may be bonded to the front surfaces of the first and second perforated sheets respectively by a nickel plating or by a brazing material. The first and second layers of abrasive grains may have the same degree of abrasiveness or two different degrees of abrasiveness.

In general, in another aspect, the invention features an abrasive tool including a first base having a front surface and a back surface, the back surface having sonic weld joints, and a second base having a front surface and a back surface, the back surface having sonic weld joints. A first perforated sheet has a front surface and a back surface, the back surface of the first perforated sheet being bonded to the front surface of the first base. A second perforated sheet has a front surface and a back surface, the back surface of the second perforated sheet being bonded to the front surface of the second base. A first layer of abrasive grains is bonded to the front surface of the first perforated sheet, and a second layer of abrasive grains is bonded to the front surface of the second perforated sheet. The back surface of the first base is bonded to the back surface of the second base by sonic welding.

In general, in another aspect, the invention features a method of assembling an abrasive tool, including providing a first base having a front surface and a back surface, a second base having a front surface and a back surface, a first perforated sheet having a front surface and a back surface, and a second perforated sheet having a front surface and a back surface. The front surface of the first base is bonded to the back surface of the first perforated sheet, and the front surface of the second base is bonded to the back surface of the second perforated sheet. A first layer of abrasive grains is bonded to the front surface of the first perforated sheet, and a second layer of abrasive grains is bonded to the front surface of the second perforated sheet. The back surfaces of the first and second bases are bonded.

Implementations of the invention may include one or more of the following features. The bonding of the back surfaces of the first and second bases may include sonic welding. The bonding of the first and second bases to the first and second perforated sheets respectively may be performed prior to the bonding of the first and second layers of abrasive grains.

The first and second perforated sheets may have perforations arranged to form an interrupted cut pattern. The first base and the second base may comprise a plastic material.

The back surfaces of the first and second bases may be joined by sonic weld joints. The front surfaces of the first and second bases may be bonded to the back surfaces of the first and second sheets respectively by injection molding.

The perforations in the perforated sheets may be counterbored. The first and second perforated sheets have perforations in a portion less than the entirety of the sheets.

The first and second layers of abrasive grains may have the same degree of abrasiveness or two different degrees of abrasiveness. The method may include grinding the front surfaces of the first and second perforated sheets prior to the bonding of the first and second layers of abrasive grains to the first and second perforated sheets respectively.

The bonding of the first and second layers of abrasive grains to the front surfaces of the first and second perforated sheets respectively may include electroplating, anodizing or brazing.

An advantage of the present invention is the versatility of the abrasive tool, which may have different grades of abrasiveness on each of the surfaces of the perforated sheets.

An additional advantage of the present invention is the flatness and dimensional stability of the abrasive tool.

A further advantage of the present invention is the strength and durability of the abrasive tool.

Other features and advantages of the invention will become apparent from the following detailed description, and from the claims.

DESCRIPTION OF THE PREFERRED EMBODIMENTS

An abrasive tool according to the present invention includes two bases bonded to each other and two perforated sheets onto which abrasive grains are bonded.

Figure 1:
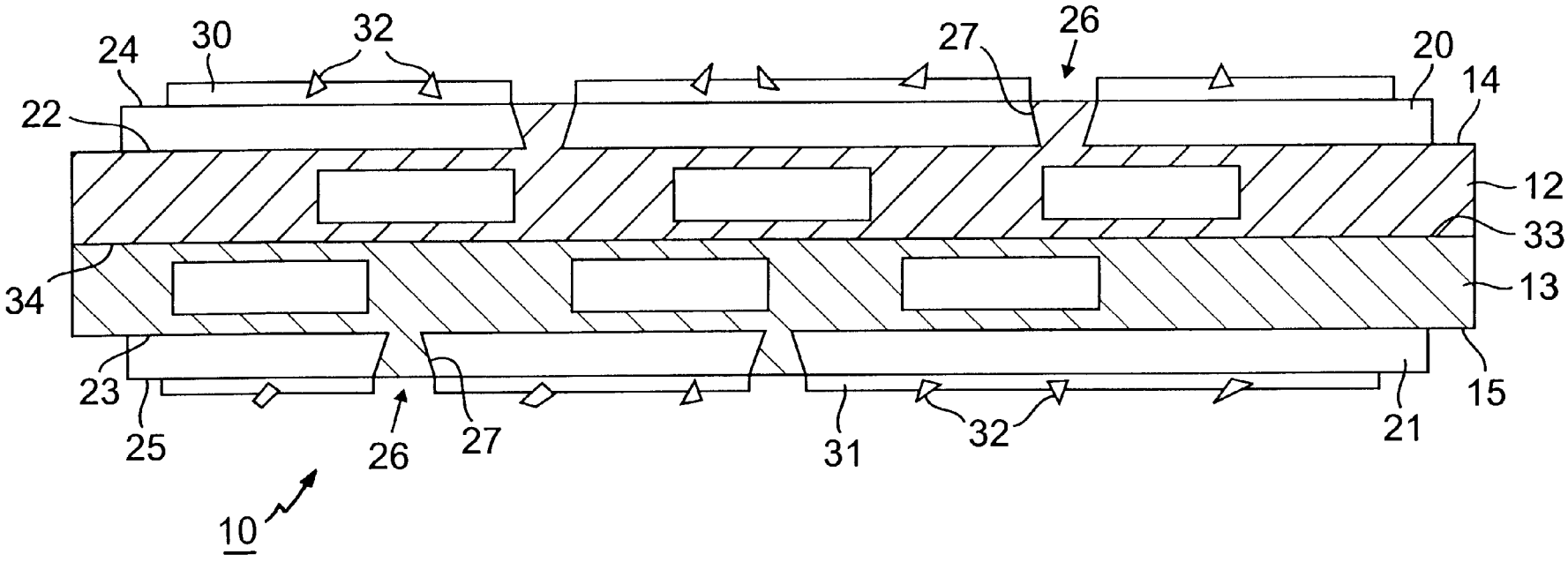
FIG. 1 is a side view of a file constructed according to the present invention.
Figure 2:
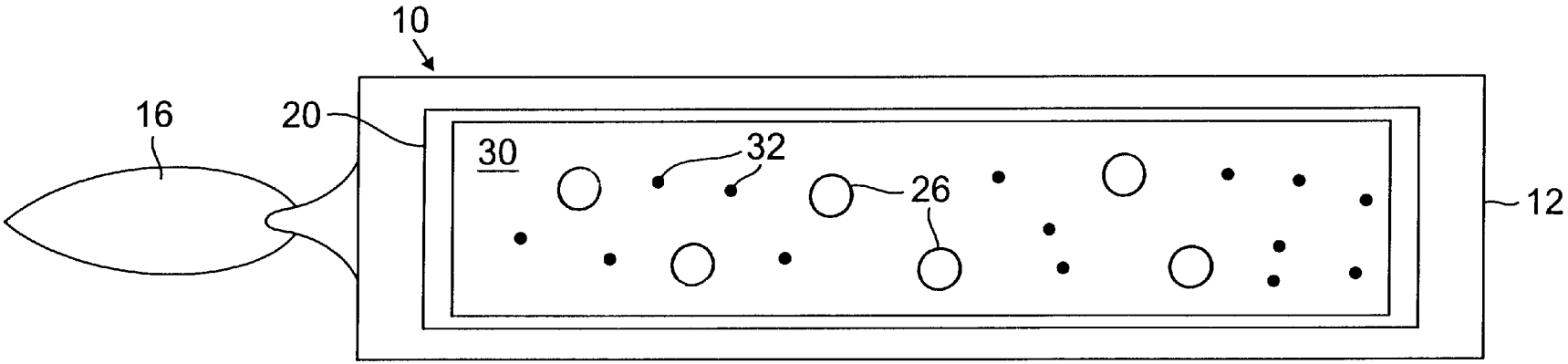
FIG. 2 is a plan view of the upper surface of the file of FIG. 1.
Figure 3:
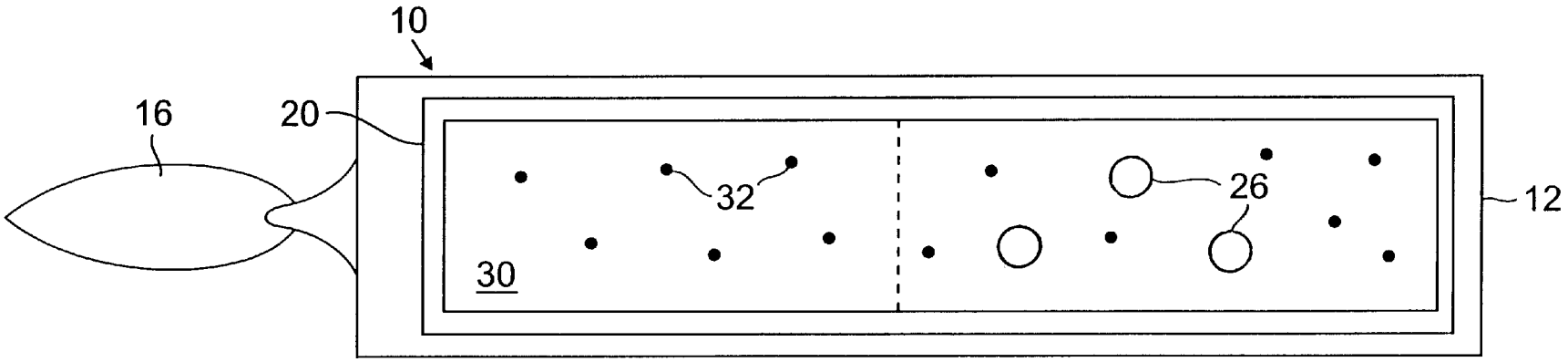
FIG. 3 is a plan view of an alternate embodiment of the upper surface of the file of FIGS. 1 and 2 which is perforated over only a portion of its abrasive surface.

As shown in FIGS. 1, 2 and 3, the abrasive tool may be a hand-held file 10. The abrasive tool may also be, e.g., a whetstone, a grinding wheel or a slip stone. File 10 includes rigid bases 12, 13. File 10 may also include a handle 16, which may be removable, or which may be permanently fixed to either or both of bases 12, 13.

Bases 12, 13 have front surfaces 14, 15 and back surfaces 33, 34. Bases 12, 13 may be formed as solid structures. Alternately, bases 12, 13 may be partially hollow (FIG. 1), e.g., with a metal honeycomb structure, truss work structure, or tube and plate structure. Such a partially hollow base weighs less than a similar base with a solid structure, but is still highly rigid.

Bases 12, 13 are preferably made from a plastic material. Further, bases 12, 13 may be any shape, e.g., flat, round, conical or curved.

Figure 4:
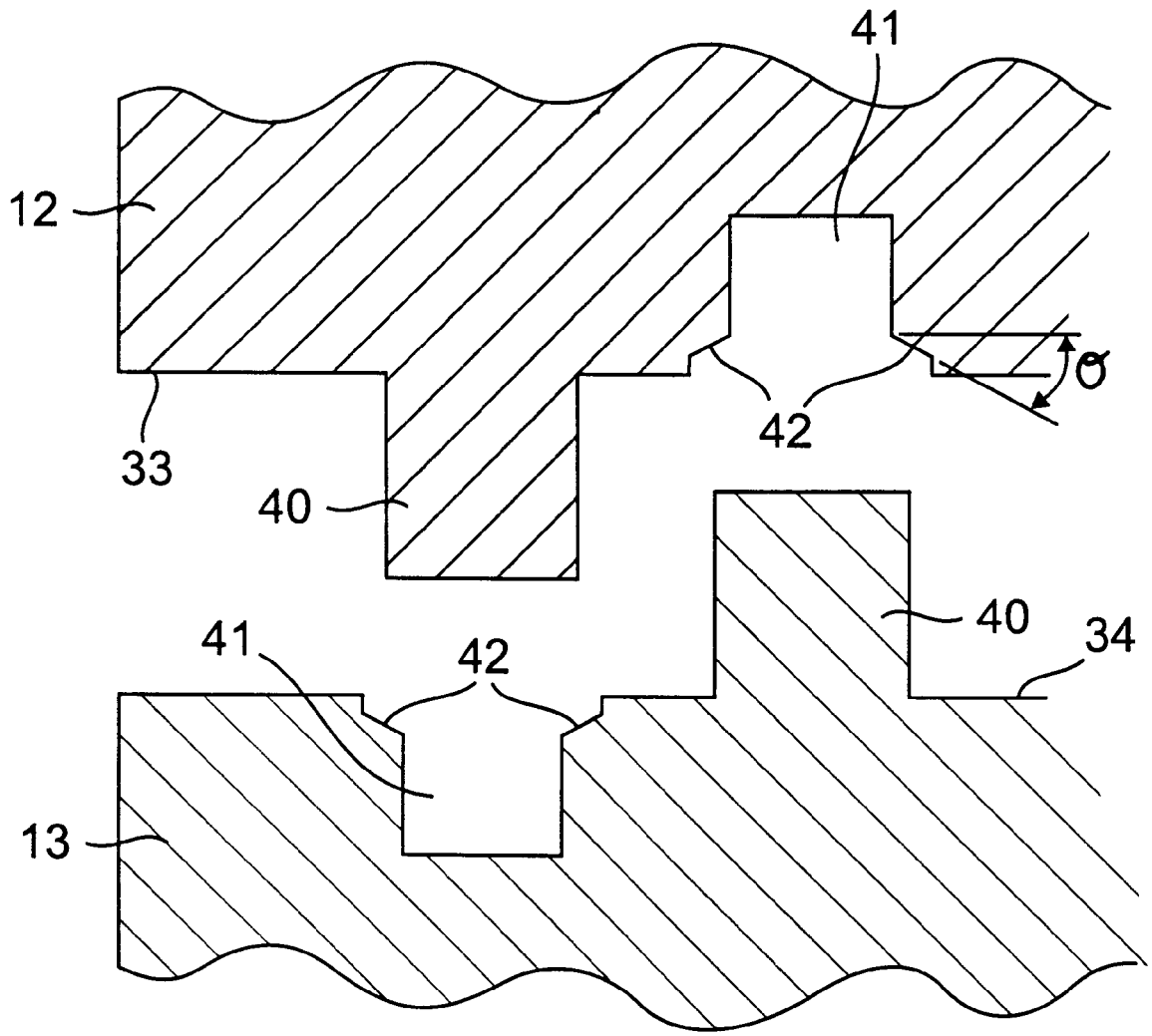
FIG. 4 is a fragmentary side view of a weld joint used in the construction of the file of FIG. 1.
Figure 5:
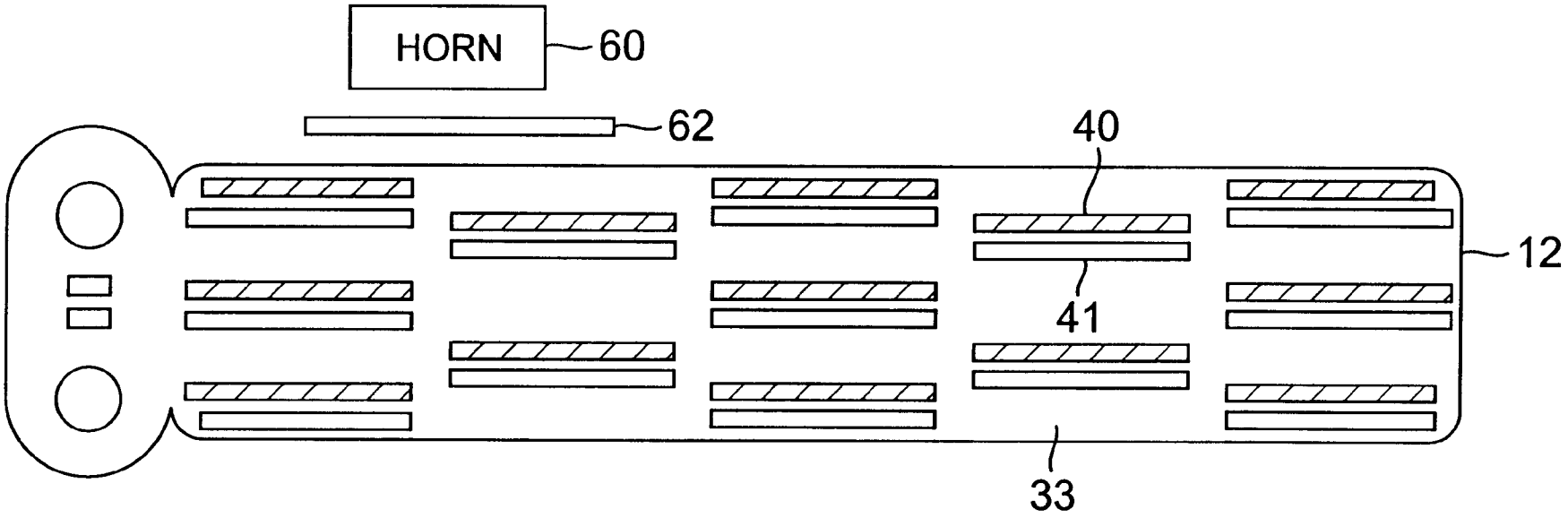
FIG. 5 is a plan view of the back surface of a plastic base showing weld joints as in FIG. 4.

In a preferred embodiment, the back surfaces 33, 34 of bases 12, 13 are shaped in the form of sonic weld joints. As shown in FIGS. 4 and 5, the weld joints involve corresponding sets of elongated flanges 40 and troughs 41 on the back surfaces 33, 34 of bases 12, 13. Flanges 40 and troughs 41 are distributed over back surfaces 33, 34 so that flanges 40 fit into opposing troughs 41 when bases 12, 13 are aligned for joining. Troughs 41 may also include bevelled openings 42 to facilitate joining with flanges 40.

Flanges 40 may be approximately 0.050 inch wide and protrude approximately 0.035 inch from back surfaces 33, 34 of bases 12, 13. Opposing troughs 41 may be approximately 0.042±0.002 inch wide and 0.045 inch deep. Flanges 40 and troughs 41 may be separated by approximately 0.036 inch. The length of each weld joint may be approximately 0.750 inch. Bevelled openings 42 on troughs 41 are approximately 0.055 inch wide at the widest point and form angles $\theta$ of approximately 30° with back surfaces 33, 34 of bases 12, 13. With this arrangement, flanges 40 may be easily located by bevelled openings 42 to be pushed into opposing troughs 41. Flanges 40, which are preferably made of plastic, deform to fit into troughs 41 when pushed into troughs 41.

File 10 also includes sheets 20, 21. Sheets 20, 21 have front surfaces 24, 25 and back surfaces 22, 23. The back surfaces 22, 23 of sheets 20, 21 are bonded to the front surfaces 14, 15 of bases 12, 13.

Sheets 20, 21 may be made of any metal, e.g., stainless steel or aluminum. Sheets 20, 21 are preferably made from a hard metal such as steel. Sheets 20, 21 contain perforations, e.g. round holes 26, extending through sheets 20, 21. Preferably, the perforations in sheets 20, 21 also have a bevelled or counterbore configuration 27 that anchors sheets 20, 21 to bases 12, 13 (FIG. 1).

The perforations may have any shape, e.g., square, circular, or diamond shaped holes. A preferred embodiment of the present invention includes sheets for which 40% of the surface area has been cut out for the perforations. In an alternate embodiment, only a portion of sheets 20, 21 contains perforations, while the remainder contains no perforations (FIG. 3). Any arbitrary portion of sheets 20, 21 may contain perforations.

Sheets 20, 21 are preferably bonded to bases 12, 13 by injection molding. By injection molding, a heated plastic material that forms bases 12, 13 bonds to the back surfaces 22, 23 of sheets 20, 21 and flows into counterbored perforation holes 26. Upon cooling, bases 12, 13 harden and become anchored to sheets 20, 21, since the plastic material that has flowed into counterbored perforation holes 26 resists separation of bases 12, 13 from sheets 20, 21.

Abrasive surfaces 30, 31 are formed on front surfaces 24, 25 of sheets 20, 21. Abrasive surfaces 30, 31 may be, e.g., grinding, honing, lapping or deburring surfaces, and may be, e.g., flat or curved, depending on the shape and use of the abrasive tool.

Abrasive surfaces 30, 31 are formed by bonding abrasive grains 32 to front surfaces 24, 25 of sheets 20, 21 in areas other than holes 26. Abrasive grains 32 do not bond to the base material, e.g. plastic, within holes 26. Since abrasive surfaces 30, 31 extend above the surface of sheets 20, 21, front surfaces 24, 25 of sheets 20, 21 have an interrupted cut pattern which provides recesses into which filed or deburred particles or chips may fall while the abrasive tool is being used on a work piece. An abrasive tool with an interrupted cut pattern is able to cut or file the work piece faster by virtue of providing chip clearance.

Abrasive grains 32 may be particles of, e.g., superabrasive monocrystalline diamond, polycrystalline diamond, or cubic boron nitride. Abrasive grains 32 may be bonded to front surfaces 24, 25 of sheets 20, 21 by electroless or electrode plated nickel, solder bonding, or braze bonding.

Abrasive surfaces 30, 31 may be given the same degree of abrasiveness by subjecting front surfaces 24, 25 of sheets 20, 21 to identical processes. Alternately, the abrasive surfaces 30, 31 may be given differing degrees of abrasiveness, by bonding different types, sizes, or concentrations of abrasive grains 32 onto the two front surfaces 24, 25 of sheets 20, 21.

Abrasive grains 32 may be bonded to front surfaces 24, 25 of sheets 20, 21 by electroplating or anodizing aluminum precharged with diamond. See, e.g., U.S. Pat. No. 3,287,862, which is incorporated herein by reference. Electroplating is a common bonding technique for most metals that applies Faraday's law. For example, the sheets 20, 21 bonded to bases 12, 13 are attached to a negative voltage source and placed in a suspension containing positively charged nickel ions and diamond particles. As diamond particles fall onto front surfaces 24, 25 of sheets 20, 21, nickel builds up around the particles to hold them in place. Thus, the diamond particles bonded to front surfaces 24, 25 of sheets 20, 21 are partially buried in a layer of nickel.

In addition, the holes 26 in sheets 20, 21 may be filled or covered with a resist material before bonding the diamond particles to avoid depositing diamond particles inside holes 26. The resist material may be, e.g., a resin. The resist material may be left in place or removed from holes 26 after the diamond particles have been bonded to front surfaces 24, 25 of sheets 20, 21.

Alternately, abrasive grains 32 such as diamond particles may be sprinkled onto front surfaces 24, 25 of sheets 20, 21, and then a polished steel roller which is harder than sheets 20, 21 may be used to push abrasive grains into front surfaces 24, 25 of sheets 20, 21. For example, in this case sheets 20, 21 may be aluminum.

Alternately, abrasive grains 32 may be bonded to front surfaces 24, 25 of sheets 20, 21 by brazing. For example, to bond diamond particles by brazing, a soft, tacky brazing material or shim, e.g., in the form of a paste, spray or thin solid layer, is applied to the front surfaces 24, 25 of sheets 20, 21. The shims are made, e.g., from an alloy of a metal and a flux material that has a melting point lower than the melting point of sheets 20, 21.

Diamond particles are poured onto the shim, which holds many of the diamond particles in place due to its tackiness. Excess diamond particles that do not adhere to the shim may be poured off. Sheets 20, 21 are then heated until the shim melts. Upon solidification, the diamond particles are embedded in the shim, which is also securely bonded to the front surfaces 24, 25 of sheets 20, 21. In addition, diamond particles can be kept out of the holes 26 in sheets 20, 21 by failing to apply the shim material inside holes 26.

Bases 12, 13 are preferably bonded to each other by sonic welding of back surfaces 33, 34. Sonic welding involves an oscillating horn 60 (FIG. 5) that generates vibrations having a high power output, e.g., 2000 Watts at a frequency of 20 kHz. Oscillating horn 60 is applied to the front surface of one of the perforated sheets. The high-power vibrations soften and liquify bases 12, 13 at the interface between back surfaces 33, 34. Subsequent cooling bonds bases 12, 13 together. Sonic welding directs vibrational energy at a specific region in the plastic bases, and creates an hermetic seal between the bases without solvents, adhesives, or other bonding agents.

A sacrificial film layer 62 may be interposed between oscillating horn 60 and the perforated sheet during sonic welding. Layer 62 prevents degradation of both oscillating horn 60 and the abrasive layer on the perforated sheet during sonic welding. Layer 60 is preferably made of polypropylene plastic.

Figure 6:
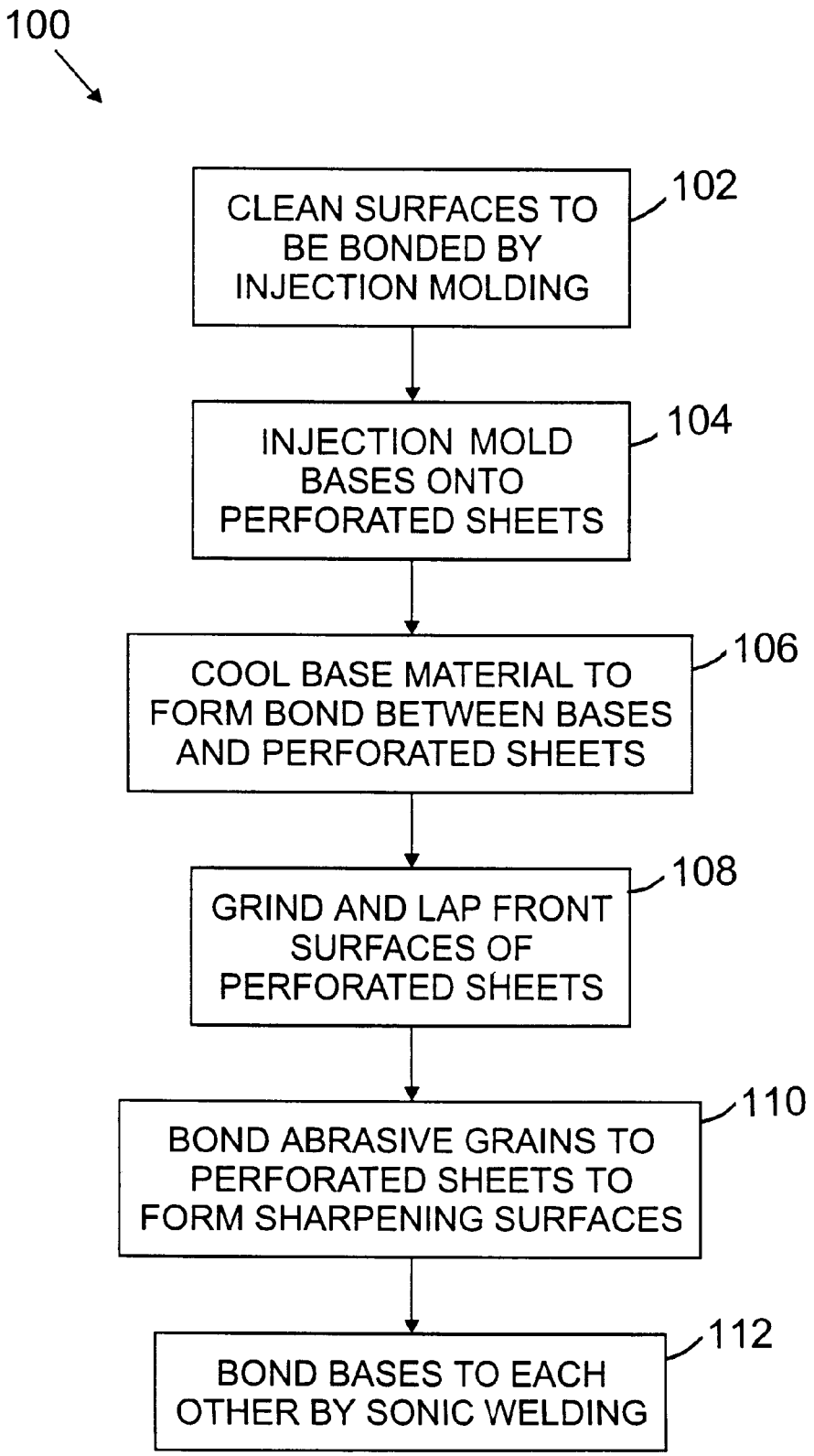
FIG. 6 is a flow chart showing a method of assembling an abrasive tool according to the present invention.

FIG. 6 shows a method 100 for constructing file 10. First, back surfaces 22, 23 of perforated sheets 20, 21 may be cleaned (step 102). Bases 12, 13 are formed on and bonded to back surfaces 22, 23 of sheets 20, 21 by injection molding, i.e. by injecting heated, softened plastic material onto back surfaces 22, 23 of sheets 20, 21 (step 104). The plastic material cools to form the bond between bases 12, 13 and sheets 20, 21 (step 106).

The front surfaces 24, 25 of sheets 20, 21 may then be ground or lapped for precision flatness (step 108). Abrasive grains 32 are then bonded to front surfaces 24, 25 of sheets 20, 21 to form abrasive surfaces 30, 31 (step 110).

In a preferred embodiment, sheets 20, 21 are bonded to bases 12, 13 (steps 104 and 106) prior to forming abrasive surfaces 30, 31 (step 110). In particular, the use of non-conductive plastic bases 12, 13 minimizes the quantity of adhesive grains 32 that are used; i.e. nickel will not be deposited on non-conductive plastic bases 12, 13 during the electroplating process, so that no diamond grains 32 will accumulate on bases 12, 13. Alternately, abrasive surfaces may be formed on sheets 20, 21 (step 110) prior to bonding sheets 20, 21 to bases 12, 13 (steps 104 and 106).

Finally, the back surfaces 33, 34 of bases 12, 13 are bonded to each other, e.g., by sonic welding (step 112).

A perforated sheet onto which abrasive grains are bonded and that has been mounted on a base may be attached, e.g. by sonic welding, to a single surface or to multiple surfaces.

Other embodiments are within the scope of the following claims.

What is claimed is:

1. An abrasive tool, comprising:

a first base having a front surface and a back surface;

a second base having a front surface and a back surface;

a first perforated sheet having a front surface and a back surface, the back surface of the first perforated sheet bonded to the front surface of the first base;

a second perforated sheet having a front surface and a back surface, the back surface of the second perforated sheet bonded to the front surface of the second base;

a first layer of abrasive grains bonded to the front surface of the first perforated sheet; and a second layer of abrasive grains bonded to the front surface of the second perforated sheet;

wherein the back surface of the first base is bonded to the back surface of the second base.

2. The abrasive tool according to claim 1 wherein the back surface of the first base is bonded to the back surface of the second base by sonic welding.

3. The abrasive tool according to claim 1 wherein the first and second perforated sheets have perforations arranged to form an interrupted cut pattern.

4. The abrasive tool according to claim 1 wherein the first base and the second base comprise a plastic material.

5. The abrasive tool according to claim 1 wherein the back surfaces of the first and second bases are joined by sonic weld joints on the back surfaces of the first and second bases.

6. The abrasive tool according to claim 1 wherein the front surfaces of the first and second bases are bonded to the back surfaces of the first and second sheets respectively by injection molding.

7. The abrasive tool according to claim 1 wherein the perforations in the perforated sheets are counterbored.

8. The abrasive tool according to claim 7 wherein the front surfaces of the first and second bases are bonded to the back surfaces of the first and second sheets respectively by injection molding.

9. The abrasive tool according to claim 8 wherein the injection molded bond anchors the first and second perforated sheets to the first and second bases respectively by the counterbored perforations.

10. The abrasive tool according to claim 1 wherein the first and second perforated sheets have perforations in a portion less than the entirety of the sheets.

11. The abrasive tool according to claim 1 wherein the tool is a file.

12. The abrasive tool according to claim 1 wherein the first and second layers of abrasive grains are bonded to the front surfaces of the first and second perforated sheets respectively by a nickel plating.

13. The abrasive tool according to claim 1 wherein the first and second layers of abrasive grains are bonded to the front surfaces of the first and second perforated sheets respectively by a brazing material.

14. The abrasive tool according to claim 1 wherein the first and second layers of abrasive grains have two different degrees of abrasiveness.

15. The abrasive tool according to claim 1 wherein the first and second layers of abrasive grains have the same degree of abrasiveness.

16. An abrasive tool, comprising:

a first base having a front surface and a back surface, the back surface comprising sonic weld joints;

a second base having a front surface and a back surface, the back surface comprising sonic weld joints;

a first perforated sheet having a front surface and a back surface, the back surface of the first perforated sheet bonded to the front surface of the first base;

a second perforated sheet having a front surface and a back surface, the back surface of the second perforated sheet bonded to the front surface of the second base;

a first layer of abrasive grains bonded to the front surface of the first perforated sheet; and a second layer of abrasive grains bonded to the front surface of the second perforated sheet;

wherein the back surface of the first base is bonded to the back surface of the second base by sonic welding.

17. A method of assembling an abrasive tool, comprising:

providing a first base having a front surface and a back surface, a second base having a front surface and a back surface, a first perforated sheet having a front surface and a back surface, and a second perforated sheet having a front surface and a back surface;

bonding the front surface of the first base to the back surface of the first perforated sheet;

bonding the front surface of the second base to the back surface of the second perforated sheet;

bonding a first layer of abrasive grains to the front surface of the first perforated sheet;

bonding a second layer of abrasive grains to the front surface of the second perforated sheet; and bonding the back surfaces of the first and second bases.

18. The method of claim 17 wherein bonding the back surfaces of the first and second bases comprises sonic welding.

19. The method of claim 17 wherein the bonding of the first and second bases to the first and second perforated sheets respectively is performed prior to the bonding of the first and second layers of abrasive grains.

20. The method of claim 17 wherein the first and second perforated sheets have perforations arranged to form an interrupted cut pattern.

21. The method of claim 17 wherein the first base and the second base comprise a plastic material.

22. The method of claim 17 wherein the back surfaces of the first and second bases are joined by sonic weld joints.

23. The method of claim 17 wherein the front surfaces of the first and second bases are bonded to the back surfaces of the first and second sheets respectively by injection molding.

24. The method of claim 17 wherein the perforations in the perforated sheets are counterbored.

25. The method of claim 17 wherein the first and second perforated sheets have perforations in a portion less than the entirety of the sheets.

26. The method of claim 17 wherein the first and second layers of abrasive grains have two different degrees of abrasiveness.

27. The method of claim 17 wherein the first and second layers of abrasive grains have the same degree of abrasiveness.

28. The method of claim 17 further comprising grinding the front surfaces of the first and second perforated sheets prior to the bonding of the first and second layers of abrasive grains to the first and second perforated sheets respectively.

29. The method of claim 17 wherein the bonding of the first and second layers of abrasive grains to the front surfaces of the first and second perforated sheets respectively comprises electroplating.

30. The method of claim 17 wherein the bonding of the first and second layers of abrasive grains to the front surfaces of the first and second perforated sheets respectively comprises anodizing.

31. The method of claim 17 wherein the bonding of the first and second layers of abrasive grains to the front surfaces of the first and second perforated sheets respectively comprises brazing.

* * * * *